United States Patent [19]

Ebert et al.

[11] 4,159,601

[45] Jul. 3, 1979

[54] BEARER PANEL WITH MOVABLE SUPPORTING DEVICES

[75] Inventors: Claus Ebert, Kronberg; Wolfgang Fabian, Mannheim, both of Fed. Rep. of Germany

[73] Assignee: Isopol A.G., Switzerland

[21] Appl. No.: 790,670

[22] Filed: Apr. 25, 1977

[30] Foreign Application Priority Data

Apr. 23, 1976 [CH] Switzerland ..... 5123/76
Feb. 10, 1977 [CH] Switzerland ..... 1595/77

[51] Int. Cl.[2] ..... E04D 13/00

[52] U.S. Cl. ..... 52/36; 248/243

[58] Field of Search ..... 248/243, 224.2, 223.3, 248/222.2, 220.4; 40/143; 52/36; 174/48; 339/21 R

[56] References Cited

U.S. PATENT DOCUMENTS

| | | | |
|---|---|---|---|
| 857,543 | 6/1907 | Thomas | 248/243 |
| 2,220,618 | 11/1940 | Tschopp | 339/21 R |
| 2,223,680 | 12/1940 | Fischer | 248/224.2 |
| 2,240,180 | 4/1941 | Frank | 339/21 R |
| 2,243,990 | 6/1941 | Thorn | 339/21 R |
| 2,879,614 | 3/1959 | Baldanza | 40/143 |
| 2,981,669 | 4/1961 | Brand | 52/594 |
| 3,112,912 | 12/1963 | Alvarez | 248/243 |
| 3,502,222 | 3/1970 | Crawfoord | 248/224.2 |
| 3,838,381 | 9/1974 | DeVillemeur | 339/21 R |

FOREIGN PATENT DOCUMENTS

| | | | |
|---|---|---|---|
| 825376 | 10/1969 | Canada | 40/622 |
| 1090407 | 10/1960 | Fed. Rep. of Germany | 248/224.2 |
| 2240992 | 3/1974 | Fed. Rep. of Germany | 248/222.2 |
| 2232260 | 12/1974 | France | 40/143 |
| 119003 | 3/1970 | Norway | 40/622 |
| 1047274 | 11/1966 | United Kingdom | 40/622 |

*Primary Examiner*—Price C. Faw, Jr.
*Assistant Examiner*—H. E. Raduazo
*Attorney, Agent, or Firm*—Robert E. Burns; Emmanuel J. Lobato; Bruce L. Adams

[57] ABSTRACT

A bearer panel has a panel body and supporting devices normally supported by the body. The body has horizontal transverse grooves which in a sectional profile thereof expand inwards. The supporting devices have lugs fitting the grooves.

12 Claims, 10 Drawing Figures

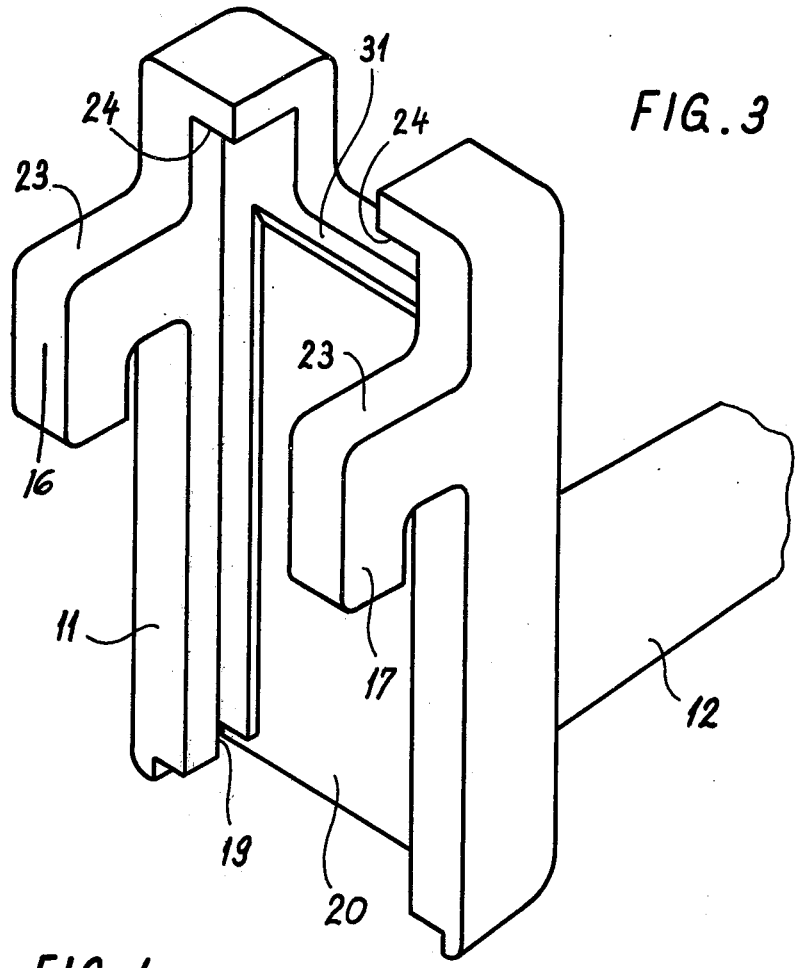
FIG. 3
FIG. 4
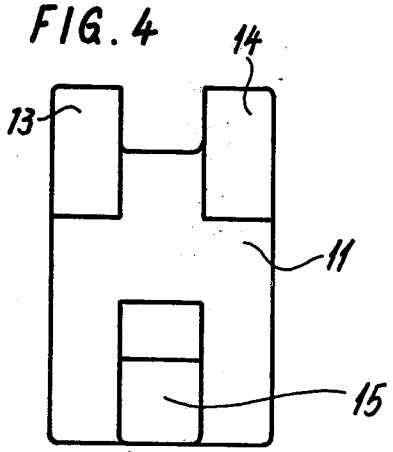
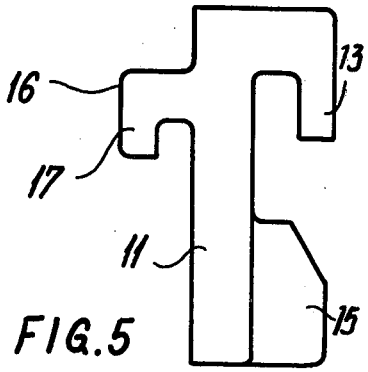
FIG. 5

VII
VII

BEARER PANEL WITH MOVABLE SUPPORTING DEVICES

BACKGROUND OF THE INVENTION

The invention refers to a bearer panel with movable supporting devices for tools, receptacles, appliances or the like as well as an advantageous method of production of such a bearer panel.

Bearer panels with movable supporting devices for fastening to walls are known, that is, usually in the form of hardboard panels with holes arranged at a certain uniform pitch, in which appropriately shaped hooks may be suspended as a supporting device and in case of necessity as each occasion demands be moved. These panels are often bordered by a channel frame in order to protect the corners and edges against mechanical action. But this does not prevent these hardboard panels from gradually softening by taking up moisture, especially in damp places, and the hooks tearing out.

Bearer panels of this kind are also known, of rigid sheet steel with holes for receiving hooks or with transverse slots for the suspension of boxes and tools, which are less susceptible to mechanical wear and tear but exhibit a considerable weight and are sensitive to attack by rust. Furthermore they cause annoying noise, above all when they are mounted in erection-vehicles, workshop trucks or the like.

All these bearer panels which sometimes are also employed as the back walls of cupboards have, however, the common disadvantage that the pitch of the supporting devices, in particular the transverse pitch in a horizontal plane, is fixed like a grid by the uniform arrangement of holes and slots and thereby often cannot be adapted to predetermined dimensions and shapes of the objects to be supported. The result is then insecure support and hold of the objects, which in the case, for example, of heavy tools such as drilling machines or sharp-edged appliances such as saws, may lead to damage and accidents.

The purpose of the invention is the avoidance of this disadvantage and the creation of a possibility with a bearer panel of that kind of being able to move the supporting devices in a horizontal plane as required and without being tied to a certain grid or module but in that case without impairing the security of hold.

SUMMARY OF THE INVENTION

For this purpose a bearer panel of the kind mentioned above is in accordance with the invention characterized by horizontal transverse grooves which in sectional profile widen inwards, into which the supporting devices can be inserted by at least one lug. For heavier loadings these supporting devices may be provided with two lugs arranged vertically one below the other, the upper one of which can be inserted in the upper arm of one transverse groove and the lower one of which can be inserted in the lower arm of a transverse groove arranged below the former.

It has further proved advantageous to fix these supporting devices in plane along the transverse grooves in the bearer panel in order to avoid an unwanted sideways shifting or even dropping out of these supporting devices with clumsy handling. For this purpose the supporting devices may exhibit two lugs arranged horizontally side by side in the upper region on the back of a supporting panel and a slidepiece which can be moved vertically between them and which can be moved upwards until its top edge is above the upper face of the lugs and be locked in this position.

In this way not only is fixing of the supporting devices achieved which is simple and also safe through locking, but by the lugs arranged horizontally side by side the advantage is also as the same time achieved that for fitting the supporting devices only one transverse groove in the bearer plate is necessary in each case, because both lugs are inserted side by side in the same transverse groove. Thereby more supporting devices may be arranged one under the other than with supporting devices which for their fixing engage by two lugs arranged one above the other in two transverse grooves running in parallel one below the other.

The panel itself may be produced from any suitable material, for example, in one piece by profiled extruding of a suitable structural foam. Because of the friction occurring in that case and for reasons of uniform cooling off it has, however, proved advantageous to manufacture the panel in two stages. Such a process consists in a panel which at least on one side is wavy or scalloped in sectional profile being produced and the parallel transverse ribs then being provided on their upper side with fillets the width of which is greater than that of the transverse ribs and the longitudinal edges of which stand out on both sides over the longitudinal edges of the ribs.

In that case it may be advantageous for reasons of manufacturing technique, in particular at the discharge from the extruder, if the panel exhibits a uniform wall thickness.

Obviously the employment of a panel of another mechanically workable material is possible, in the face of which the profiled transverse grooves are worked, for example, by milling. If a relatively high loading by the supporting of heavy parts is to be expected, the panel may also be provided with an additional reinforcing panel on the back of it, which may consist of any suitable material, especially plastics, and be glued, welded or screwed onto the back of the bearer panel.

BRIEF DESCRIPTION OF THE DRAWINGS

In the attached drawings embodiments are illustrated for the sake of example and a preferred application of a bearer plate made in accordance with the invention, as well as different supporting devices, there being shown in.

DESCRIPTION OF THE PREFERRED EMBODIMENTS

Accordingly, the bearer panel 1 exhibits at least on one side an approximately wavy or scalloped profiling in the vertical direction and is provided with a plurality of parallel transverse grooves 2. These transverse grooves 2 may be open at both outer vertical edges of the panel or else closed or else open at only one end and closed at the other. Closing-off of the transverse grooves at one and respectively or at the other end may either be provided already in the manufacture of the panel or else effected only subsequently by inserted and screwed-in profile pieces as is of itself known in the case of curtain rail profiles.

Figure 1:
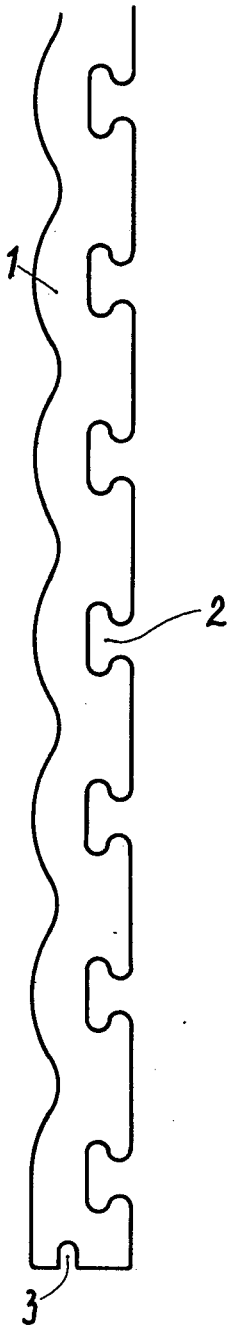
FIG. 1 the elevation of the profile of one embodiment in the direction of the arrow A in FIG. 10, FIG. 2 the elevation of the profile of another embodiment of the panel in the same view as FIG. 1, FIG. 3 in perspective a further supporting device in the form of a hook, FIGS. 4 and 5 the front and side elevations of a supporting device for the suspension of boxes or receptacles, FIG. 6 in perspective a slidepiece for securing and locking the supporting devices, FIG. 7 a rear elevation of the slidepiece, FIG. 8 a plan of it, and FIG. 9 a side elevation of it, partially in section along VII—VII in FIG. 7, as well as FIG. 10 the practical application of a panel in accordance with the invention in the case of a tool cupboard of which only the rear wall as well as one sidewall and one leaf of the door from the lefthand half are illustrated with the parts exploded.

The transverse grooves 2 exhibit a cross-section which widens inwards. This may have rounded contours (FIG. 1) or be made rounded and angular (FIG. 2) or only angular or else dovetail-shaped.

If any kind of electrical or electronic apparatus are to be fitted onto the bearer panel, such as lighting fixtures, clocks, radiators or the like, the inner wall of the transverse grooves may be made at least partially electrically conductive by, for example, the transverse grooves being provided during production of the panel with an electrically conductive inlay.

A longitudinal groove 3 along the bottom and respectively or the top narrow side of the panel may be used for its alignment and guidance when it is, for example, arranged to be able to slide lengthwise in a cupboard, shelf or frame. But this longitudinal groove 3 may also receive a tenon if a further panel is fastened on by its narrow side in order to enlarge the working area or to complete it. Lateral alignment of further panels fitted at right angles is advantageously effected by means of appropriately profiled continuous connecting-fillets or individual bolts.

Figure 2:
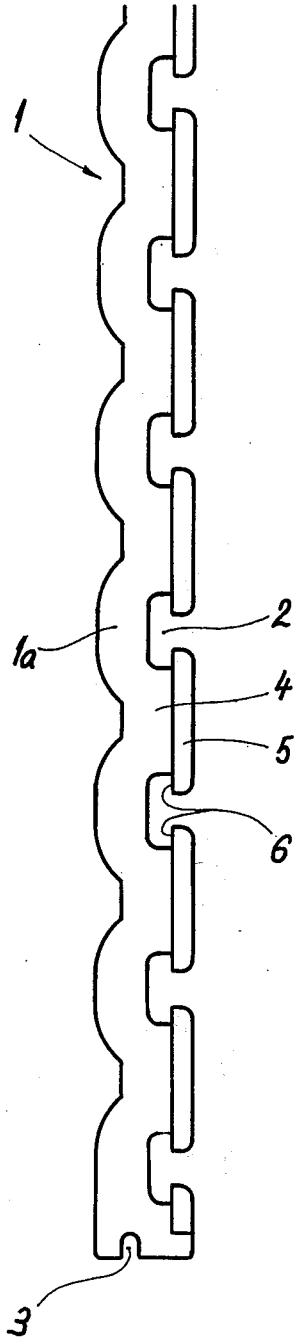
Figures 6, 7, 8, 9:
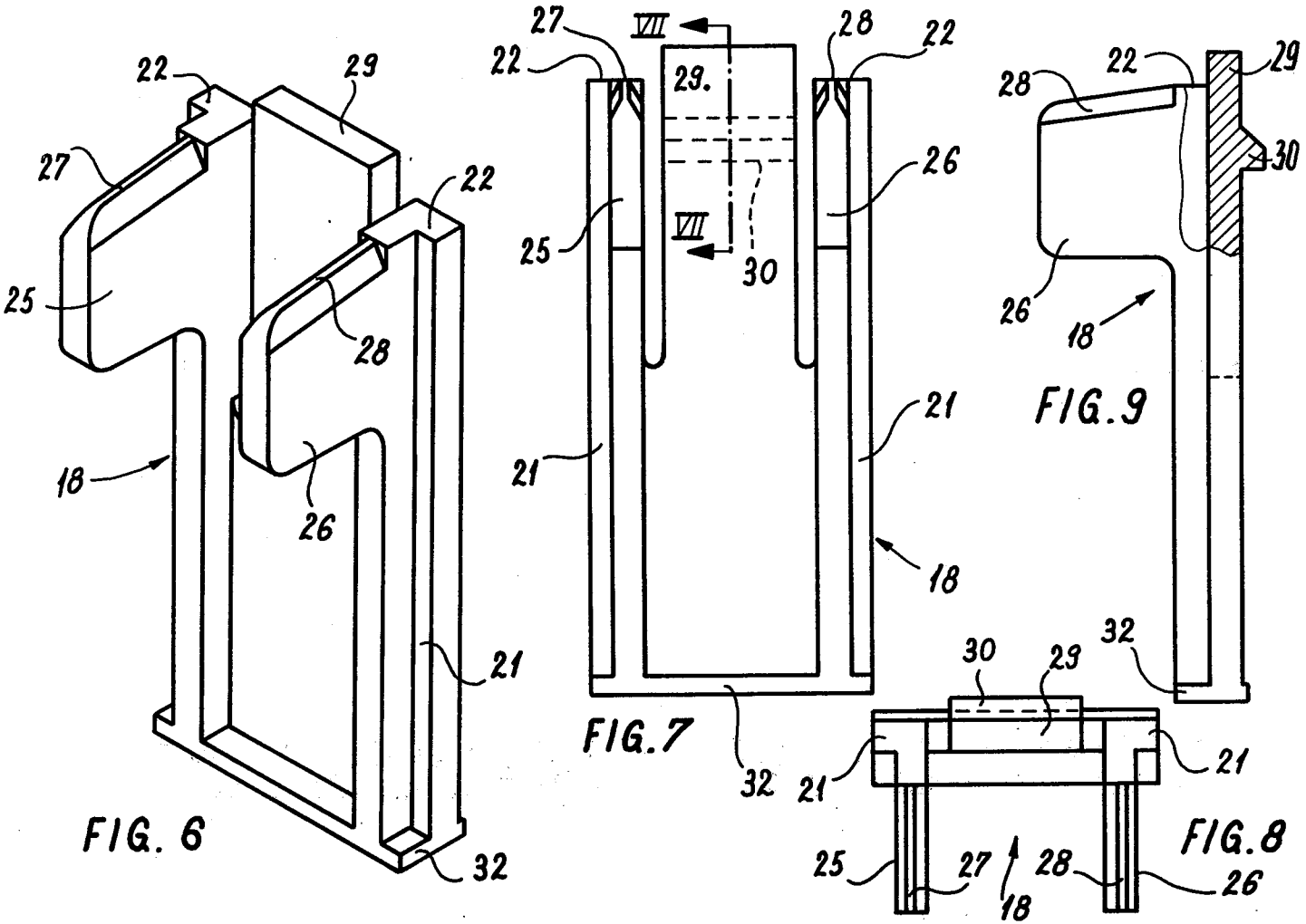

As already mentioned, in the case of manufacture of the panel 1 from an extrudable structural foam it may be advantageous on practical grounds to execute the panel in two parts as is shown by the embodiment as in FIG. 2. In that case first of all a panel 1*a* is produced which in sectional profile is at least on one side wavy or scalloped, the parallel transverse ribs 4 of which are provided with fillets 5 the width of which is greater than that of the transverse ribs and the longitudinal edges of which stand out over the longitudinal edges of the ribs. In this way vertical bearing surfaces 6 are formed on the inside of the arms of the grooves at the front. Depending upon the kind of material employed for the panel and the superimposed fillets the latter are glued, welded or screwed onto the parallel transverse ribs 4.

But it is also possible to provide the longitudinal edges of the ribs with undercut profiles and to push the fillets, correspondingly profiled at their longitudinal edges, on in the direction longitudinal to the ribs. Also a guide and hold may be provided in the centre of the rib.

A further advantageous possibility for the formation of the special form of profile of the transverse grooves consists in gluing, welding or screwing onto the surface of the parallel transverse ribs a continuous panel in which parallel slots are then milled between the transverse ribs, the width of which is less than the pitch of the transverse ribs.

The supporting devices which may be inserted in the transverse grooves 2 in the bearer panel made in accordance with the invention consist in the simplest case with only small loading, for example, in the case of a key board where only relatively light keys are hung up, of a simple hook having only one lug the vertical height of which is greater and the horizontal width of which is smaller than the gap between the edges of the grooves so that it may be inserted crosswise in the grooves and then needs merely to be twisted by 90° in order to be held by the groove.

The fixable supporting devices as in FIGS. 3 to 5 consist of a moulded body produced preferably in one piece from a suitable plastics, which exhibits a supporting panel 11 for laying against the bearer plate (not shown), and one or more hooks for receiving the objects to be attached. Whilst the hook 12 in the embodiment as FIG. 3 is arranged in the lower region on the front of the supporting panel 11 and may exhibit a free end directed upwards, in the case of the embodiment as FIGS. 4 and 5 two hooks 13 and 14 are provided in the upper region on the front of the supporting panel 11, the free ends of which are directed downwards. Between these two hooks there is furthermore attached in the lower region of the supporting panel 11 a support 15 which in its upper part is preferably bevelled off to the rear. By this arrangement the correspondingly profiled flange on a box or receptacle may be pushed under the two hooks 13 and 14 and then lowered onto the support 15, whereupon it is firmly held against the bearer panel.

The supporting devices are further provided in the upper region on the back of the supporting panel 11 with two lugs 16 and 17 arranged horizontally side by side, by which they may be inserted in a transverse groove in the bearer panel.

For securing the supporting devices after they have been inserted in a transverse groove in the bearer panel a slidepiece 18 (FIGS. 6–9) is provided, which likewise consists advantageously of a moulded body produced in one piece from a suitable plastics. This slidepiece 18 can be slid from below into a wide vertical groove 20 between the two lugs 16 and 17 on the back of the supporting panel 11, in which it is guided by the longitudinal edges 19 of this groove which, for example, may be profiled in the shape of a dovetail, by its correspondingly profiled longitudinal edges 21. The slidepiece 18 can be pushed up in this vertical groove 20 until its top edge 22 projects above the top 23 of the lugs 16 and 17 and is stopped against stops 24 at the top end of the supporting panel 11. In this way the horizontal section of the lugs 16 and 17 is widened in the vertical direction by the vertical interval between their top 23 and the stops 24, whereby the lugs inserted in a transverse groove in the bearer panel and thereby the supporting device get clamped firmly at a certain point in this transverse groove and secured against horizontal shifting.

For widening the horizontal sections of the lugs beyond their top 23 the slidepiece 18 is provided with two rigidly moulded-on ears 25 and 26 which in particular in the vertical direction exhibit areawise dimensions about twice as great as the horizontal sections of the lugs and can be pushed up and down together with the slidepiece 18 in parallel with it.

In the uppermost position of this slidepiece 18 these ears 25 and 26 project by about half their height above the top 23 of the horizontal sections of the lugs and thereby widen these by about double. These ears 25 and 26 advantageously have a top edge 27 resp. 28 bevelled in the shape of a roof whereby they penetrate from below into the upper edge of the transverse groove in the bearer panel in which the supporting device is inserted, and thus clamp it firmly there.

In order to prevent the slidepiece 18 from moving downwards by itself out of its upper clamping-position, whereby the supporting device would be loosened and be able to be shifted unintentionally along the transverse groove in the bearer panel, a springy tongue 29 is arranged between the ears 25 and 26 of the slidepiece 18. This springy tongue 29 is attached at its bottom transverse edge firmly and in one piece onto the slidepiece about halfway up and extends upwards in parallel with the longitudinal edges 21 of the slidepiece so that the top end of the tongue can reach above the top edge 22 of the slidepiece.

A little below its top end this tongue 29 on the front of it facing the supporting panel 11 of the supporting device is provided with a transverse rib 30 the upper sideface of which is bevelled and its lower sideface arranged at right angles to the outside of the tongue. Upon sliding in the slidepiece 18 from below into the vertical groove 20 in the supporting device, this transverse rib 30 shortly before reaching the uppermost position of slide, slides with its bevelled top up and over a stop 31 between the two lugs 16 and 17 on the supporting device and upon sliding the slidepiece in further it catches by its rightangled underside behind this stop 31. In this way the slidepiece 18 is locked and secured in its uppermost position of the slide and can no longer shift downwards by itself.

Unlocking is effected only if the springy tongue 29 which is accessible from the front between the two stops 24 on the supporting device is bent back and by its transverse rib 30 comes out of engagement with the central stop 31. Only then can the slidepiece 18 be slid downwards in the vertical groove 20.

The slidepiece is furthermore provided at its bottom edge also with a transverse panel 32 the dimensions of which are greater than the slidepiece guide 19, 20. This transverse panel 32 thereby prevents the slidepiece 18 from being inserted in the vertical groove 20 in the supporting device by the wrong end.

In the practical application of this lock in the form of the slidepiece 18 for fixing a supporting device in a transverse groove in the bearer panel the slidepiece 18 is first of all with the tongue 29 leading, inserted from below into the vertical groove 20 on the back of the supporting panel 11 of the supporting device until weak resistance can be felt which occurs upon the bevelled top of the transverse rib 30 on the tongue meeting the central stop 31 on the supporting panel 11 of the supporting device. In this position of slide the ears 25 and 26 on the slidepiece 18 are lying next to the lugs 16 and 17 on the supporting device, the tops 23 of the lugs and the top edges 27 and 28 of the ears being at about the same level. But since these slidepiece ears 25 and 26 are in the vertical direction about twice as tall as the sections of lug, the bottom edges of the ears are sticking out downwards by about half the height of the ears below the underside of the central section of the lugs, that is, down to about the level of the downwards bent ends of the lugs.

In this position of slide the supporting device is then inserted by both its lugs 16 and 17 from the front and at right angles to the bearer panel into one of its transverse grooves the width of which is about the height of the downwards bent ends of the lugs. As soon as the ends of the lugs abut against the back of the transverse groove or the back of the supporting panel 11 abuts against the front of the bearer panel, the supporting device is pulled downwards so that the bottom edges of the ears meet the lower edge of the transverse groove and the whole slidepiece 18 gets moved upwards. Thereupon the transverse rib 30 by springing back of the tongue 29 slides over the central stop 31 on the supporting device and catches behind or respectively over this stop with locking of the slidepiece in this uppermost position of slide. But at the same time in doing this the top edge 22 of the slidepiece 18 rests against the stops 24 on the supporting device and the top edges 27 and 28 of the ears press against the upper edge of the transverse groove in the bearer panel. Sideways shifting of the supporting device along the transverse groove in the bearer panel or even pulling out or unintentional escape of the lugs from this groove is then no longer possible.

For release of the supporting device the tongue 29 which is accessible from the front of the bearer panel at the top edge of the supporting panel 11 is first of all simply forced back, whereupon the locking of the transverse rib 30 behind the stop 31 is released and the whole supporting device is raised until the tops 23 of the lugs strike against the upper edge of the transverse groove in the bearer panel, in doing which the unlocked slidepiece 18 is moved downwards in the vertical groove 20 on the back of the supporting panel 11. The relative positions of the supporting device and the slidepiece and hence of the lugs and ears are then the same as after the insertion of the slidepiece and before the insertion of the supporting device into the transverse groove in the bearer panel, so that the supporting devices may then be simply pulled out forwards. But they may also be slide sideways along the transverse groove in the bearer panel so that then renewed lowering of the supporting device brings about relocking.

In any case, whether the hooks or shelves now exhibit two rigid lugs or ribs and get pushed in from the ends of the grooves or get inserted from the front at right angles by two rigid lugs or ribs or a rigid top one and an elastically deformable bottom one, these hooks and shelves are freely shiftable in a horizontal plane along the transverse grooves and movable to any point on the transverse grooves without being tied to a grid or module, so that the supporting devices can adapt thereby in a simple way to the respective dimensions and shapes of the objects to be supported.

Moreover it is advantageously possible to align the supporting devices with one another and to slide them together in such a way that the objects to be supported are arranged one below the other at small clearances and thus valuable storage space gets made use of to the optimum with exceptional saving of room.

Figure 10:
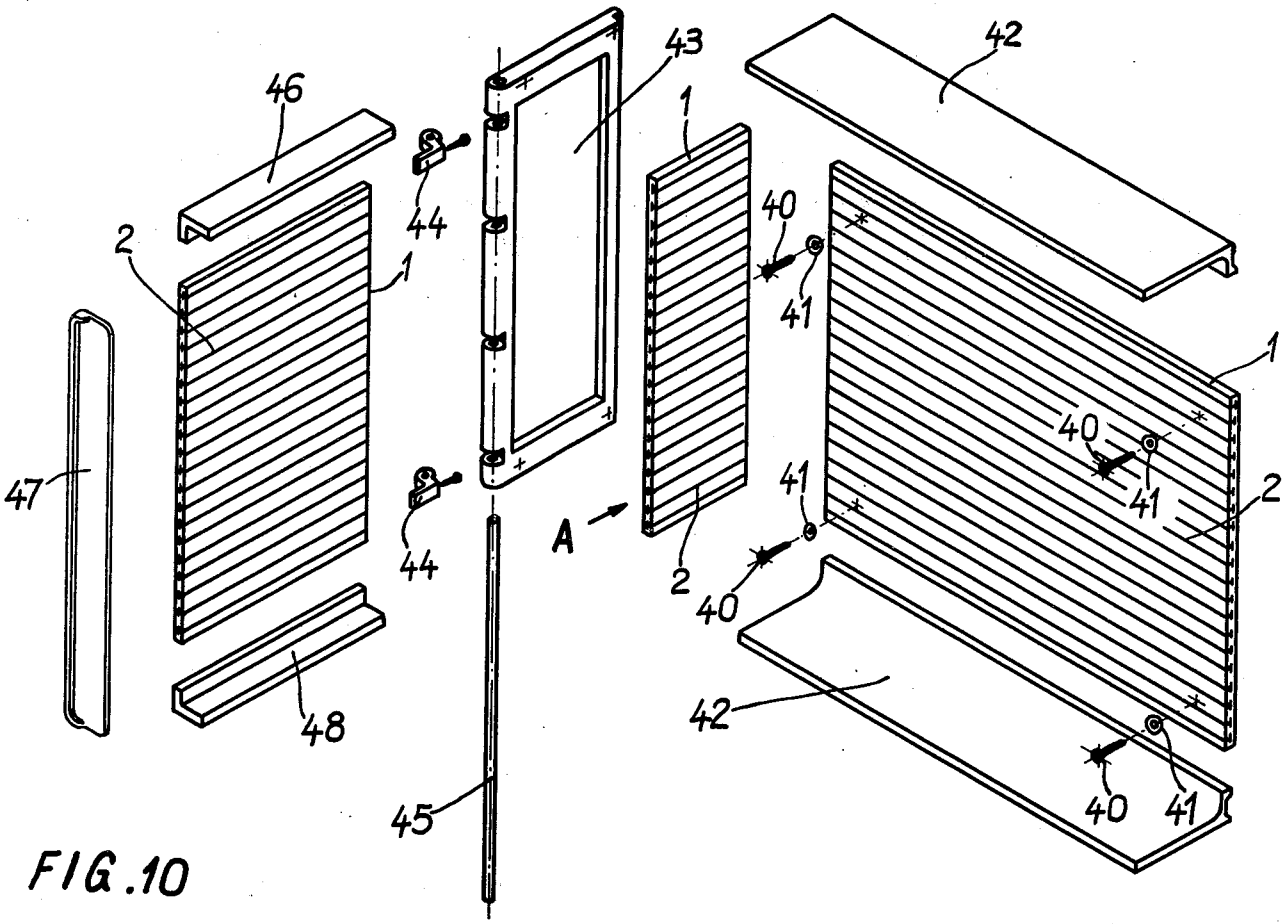

In the case of the example of practical application of the bearer panel constructed in accordance with the invention as FIG. 10 a fairly large panel 1 of a thickness of about 9 mm and having transverse grooves 2 at a pitch of about 30 mm forms the rear wall of a tool cupboard which may be attached to a wall by means of screws 40 and washers 41. The bottom and top of the cupboard are formed by horizontal shelves 42 which can be inserted in the way described into the top and bottom transverse grooves in the bearer plate acting as rear wall of the cupboard.

The sidewalls of the cupboard, only the lefthand one of which is shown, consist of a frame 43 into which likewise is fitted a bearer panel 1 in accordance with the invention, having transverse grooves 2. The lefthand door of the cupboard is hinged onto hinges 44 which are supported by means of an insertable rod 45. It consists likewise once again of a bearer panel 1 in accordance with the invention, having transverse grooves 2 and of appropriate dimensions, which is bordered by frame parts 46, 47, 48.

As this example of practical application shows, the bearer panel in accordance with the invention, with its movable supporting devices, is suitable in a particularly appropriate and advantageous way to socalled standardized unit systems for the production of tool cupboards, tool walls, shelf-and-cupboard walls, vertical-drawer cupboards, boxes or the like. All these executions can moreover in the dismantled state be shipped, stored and delivered, in which case up to about 70% space is saved.

Through the exceptional possibilities of employment of suitable, preferably foamed plastics for the manufacture of the bearer panel in accordance with the invention no rust formation, no warping and no swelling of the material occur. No tearing out and no fraying follows from overloading as in the case of hardboard panels, in partical from the action of moisture.

By varnishing, UV stability may be achieved and static charging prevented. Also better resistance against oil and grease which possibly adhere to the tools can be achieved by such surface treatment. It is again possible by means of stencils to apply symbols, figures, letters, tool outlines or pictures in order to facilitate allocation of places to the objects to be supported.

Of particular advantage, too, is the possibility of mechanical processing of material of that kind by drilling, sawing, nailing, screwing, gluing, welding, so that the amateur craftsman can produce every possible combination himself. By the employment of special adapters commercial storage boxes, shelves, etc, already in existence can be attached to a bearer panel made in accordance with the invention.

By suitable additives such as glass fibre, steel wool or the like to the material of the panel the mechanical loading capacity may be considerably increased.

On the other hand in the case of the two-part execution of the bearer panel in accordance with the invention it is possible to employ for the superimposed fillets a valuable material and for the panel itself a simpler and cheaper material, whereby the cost of production might be noticeably reduced.

We claim:

1. A bearer panel comprising; a panel body; and devices for supporting tools and the like, the devices being supportable by the body, which for this purpose has horizontal transverse grooves inwardly expanding in a sectional profile thereof, and each supporting device having a down-turned hook-shaped lug, disposed in an upper region thereof and insertable in one of the grooves, and having a slide-piece having an ear insertable in said groove, said slide-piece being movable vertically along a grooved portion of the supporting device upwards until the top edge of said ear is above an upper face of the lug, for locking the supporting device on the panel.

2. A bearer panel according to claim 1, in which the slide-piece has two ears (25,26) which, when the slide-piece has been moved vertically upwards, are disposed above the upper face of the lugs in parallel with the lugs, the slide-piece having, between the two ears, a springy tongue which in an uppermost position of the slide-piece engages the supporting panel and locks the slide-piece.

3. A bearer panel according to claim 2, in which the ears having a top edge bevelled to provide a roof-shaped profile.

4. A bearer panel according to claim 1, in which each supporting device has a vertical groove profiled in a dovetail shape, disposed on a back portion of the supporting panel body and in which the slide-piece is guided for its vertical moving.

5. A bearer panel according to claim 1, wherein each slide-piece has a bottom edge with a cross-panel larger than the grooved portion of the supporting device.

6. A bearer panel according to claim 1, wherein each supporting device has two hooks arranged horizontally side-by-side in an upper region thereof on a front part of the device and the ends of which are directed downwards, and having a support arranged between and below the hooks in a lower region of the device.

7. A bearer panel according to claim 1, having a reinforcing panel secured to a back portion of the panel body.

8. A bearer panel, comprising; a panel body constructed of plastic foam; and devices for supporting tools and the like, the supporting devices being supportable by the body, the body having horizontal transverse grooves which in a sectional profile expand into the panel in an approximate T-shape, and each supporting device having hook-shaped lugs which, in use, are inserted in a respective one of the grooves of said body, each supporting device having a vertically grooved portion and having a slide-piece movable along said vertically portion, said slide-piece having a portion inserted in said groove of said body, and means for locking said slide-piece in said grooved portion and thereby locking the the supporting device on said body.

9. A bearer panel according to claim 8, in which the plastic panel body has parallel ribs defining the grooves and having fillets on ends of the ribs to define approximate T-shape, the fillets being wider than the ribs.

10. A bearer panel according to claim 8, in which the transverse grooves are closed at edges of the panel.

11. A bearer panel according to claim 8, in which the panel body has a wavy profile, and has parallel transverse ribs each of which has at one end a fillet the width of which is greater than that of the respective transverse rib and which has longitudinal edges standing out on both sides over the longitudinal edges of the rib.

12. A bearer panel according to claim 8, in which the plastic foam body has a wavy side edge and has parallel transverse ribs which have fillets on ends thereof, the fillets being wider than the transverse ribs.

* * * * *